US008905018B2

(12) United States Patent
Ono et al.

(10) Patent No.: US 8,905,018 B2
(45) Date of Patent: Dec. 9, 2014

(54) BREATHING APPARATUS

(75) Inventors: Kenichi Ono, Tokyo (JP); Genta Santou, Tokyo (JP); Hiroyuki Ide, Tokyo (JP); Osamu Zaitsu, Tokyo (JP)

(73) Assignee: Shigematsu Works Co., Ltd., Tokyo (JP)

( * ) Notice: Subject to any disclaimer, the term of this patent is extended or adjusted under 35 U.S.C. 154(b) by 313 days.

(21) Appl. No.: 13/497,308

(22) PCT Filed: Oct. 1, 2010

(86) PCT No.: PCT/JP2010/067245

§ 371 (c)(1), (2), (4) Date: Mar. 21, 2012

(87) PCT Pub. No.: WO2011/043262

PCT Pub. Date: Apr. 14, 2011

(65) Prior Publication Data

US 2012/0222674 A1 Sep. 6, 2012

(30) Foreign Application Priority Data

Oct. 7, 2009 (JP) ..... 2009-233930
Oct. 7, 2009 (JP) ..... 2009-233931
Oct. 7, 2009 (JP) ..... 2009-233932

(51) Int. Cl.
*A62B 19/00* (2006.01)
*A62B 18/00* (2006.01)
*A62B 9/00* (2006.01)

(52) U.S. Cl.
CPC ..... *A62B 9/006* (2013.01); *A62B 18/006* (2013.01)
USPC ..... 128/201.25; 128/201.23; 128/201.28

(58) Field of Classification Search
CPC ..... A62B 18/045; A62B 7/10; A62B 18/006; A62B 23/00; A61M 16/105
USPC ..... 128/201.25, 202.22, 202.27, 201.23, 128/201.24, 201.28, 201.19, 206.19, 128/206.17, 205.25, 205.24, 205.27, 128/205.29, 206.12, 206.21, 206.24, 128/206.28, 207.11, 207.12
See application file for complete search history.

(56) References Cited

U.S. PATENT DOCUMENTS

2006/0076012 A1 4/2006 Tanizawa et al.

FOREIGN PATENT DOCUMENTS

| | | | |
|---|---|---|---|
| JP | 2002-102367 | A | 4/2002 |
| JP | 2006-102324 | A | 4/2006 |
| JP | 2009-136521 | A | 6/2006 |
| JP | 2009-89794 | A | 4/2009 |

OTHER PUBLICATIONS

International Search Report issued in corresponding application PCT/JP2010/067245, completed on Oct. 27, 2010 and mailed Nov. 9, 2010.

*Primary Examiner* — Steven Douglas
(74) *Attorney, Agent, or Firm* — Griffin & Szipl, P.C.

(57) ABSTRACT

Breathing apparatus comprising a face piece for covering the whole face of a user and a fan unit for operating synchronously with the breath timing of the user. The breathing apparatus comprises a breath monitoring apparatus provided with a diaphragm and a sensor for detecting movement of the diaphragm. The location of the diaphragm and the sensor and a transmission path of inhale pressure and exhale pressure to the diaphragm are optimized. The breath monitoring apparatus is disposed in a fan unit, a space for accommodating the diaphragm and the sensor is disposed independently of an air passage in the fan unit, and the internal space of a nose cup is communicated with the space in the fan unit through holes formed in the nose cup and the face piece when the fan unit and the nose cup are connected to the face piece.

8 Claims, 7 Drawing Sheets

BREATHING APPARATUS

This is a National Phase Application in the United States of International Patent Application No. PCT/JP2010/067245 filed Oct. 1, 2010, which claims priority on Japanese Patent Application No. 2009-233930, filed Oct. 7, 2009, Japanese Patent Application No. 2009-233931, filed Oct. 7, 2009, and Japanese Application No. 2009-233932, filed on Oct. 7, 2009. The entire disclosures of the above patent applications are hereby incorporated by reference.

TECHNICAL FIELD

The present invention relates to a breathing apparatus comprising a filter, a fan unit, a face piece for covering the whole face of a user, a nose cup for covering the mouth and the nose of the user, and a breath monitoring apparatus, wherein the filter is detachably connected to the fan unit, the fan unit is detachably connected to the face piece from the outside of the face piece, the nose cup is detachably connected to the face piece from the inside of the face piece, and the fan unit operates synchronously with the breath timing of the user detected by the breath monitoring apparatus.

BACKGROUND ART

Patent Document No. 1 teaches a breathing apparatus comprising a filter, a fan unit, a face piece for covering the whole face of a user, a nose cup for covering the mouth and the nose of the user, and a breath monitoring apparatus, wherein the filter is detachably connected to the fan unit, the fan unit is detachably connected to the face piece from the outside of the face piece, the nose cup is detachably connected to the face piece from the inside of the face piece, and the fan unit operates synchronously with the breath timing of the user detected by the breath monitoring apparatus.

PRIOR ART DOCUMENT

Patent Document

Patent Document No. 1: Japanese Patent Laid-Open Publication No. 2009-089794

DISCLOSURE OF INVENTION

Problem to be Solved

In the breathing apparatus of Patent Document No. 1, breath timing is detected by a breath monitoring apparatus comprising an exhale valve and a sensor for detecting movement of the exhale valve.

The breath monitoring apparatus comprising an exhale valve and a sensor for detecting movement of the exhale valve has a problem in that micro particulates of dust, water, etc. contaminating the exhaled air are liable to adhere to the sensor to foul it, thereby causing deterioration with age of the sensor because the sensor must be disposed in an exhale passage.

A breath monitoring apparatus comprising a diaphragm and a sensor for detecting movement of the diaphragm also has been used in breathing apparatuses. The breath monitoring apparatus comprising a diaphragm and a sensor for detecting movement of the diaphragm has an advantage in that it need not be disposed in an exhale passage.

Therefore, an object of the present invention is to provide a breathing apparatus comprising a filter, a fan unit, a face piece for covering the whole face of a user, a nose cup for covering the mouth and the nose of the user, and a breath monitoring apparatus, wherein the filter is detachably connected to the fan unit, the fan unit is detachably connected to the face piece from the outside of the face piece, the nose cup is detachably connected to the face piece from the inside of the face piece, and the fan unit operates synchronously with the breath timing of the user detected by the breath monitoring apparatus, and wherein the breath monitoring apparatus comprises a diaphragm and a sensor for detecting movement of the diaphragm, location of the diaphragm and the sensor is optimized, and a transmission path of inhalation/exhalation-induced air pressure fluctuation to the diaphragm is optimized.

The internal pressure of the face piece is desirably kept positive so as to prevent invasion of ambient contaminated air into the face piece. However, the internal pressure of the face piece can become negative when the airflow rate of the fan unit decreases due to clogging of the filter, low power supply battery voltage, or other such cause. In commercial products that are implementations of the breathing apparatus of Patent Document No. 1, an electric power supply cord for connecting the fan unit with a power supply battery independent of the fan unit is provided with a light source activated when the internal pressure of the face piece becomes negative so as to notify the user that it is time to replace the filter, charge the battery, etc.

The light source provided on the electric power supply cord for connecting the fan unit with the power supply battery is hard for the user to notice without taking it in hand and examining it closely. This results in a possibility that the user may fail to notice that the time has come to replace the filter, charge the battery, etc.

Therefore, another object of the present invention is to provide a breathing apparatus comprising a filter, a fan unit, a face piece for covering the whole face of a user, a nose cup for covering the mouth and the nose of the user, and a breath monitoring apparatus, wherein the filter is detachably connected to the fan unit, the fan unit is detachably connected to the face piece from the outside of the face piece, the nose cup is detachably connected to the face piece from the inside of the face piece, and the fan unit operates synchronously with the breath timing of the user detected by the breath monitoring apparatus, and wherein the breathing apparatus further comprises a light source which is activated when the internal pressure of the face piece becomes negative, and the light source is readily noticed by the user when activated.

In the breathing apparatus of Patent Document No. 1, the power supply battery of the fan unit is independent of the fan unit.

In the breathing apparatus of Patent Document No. 1, the fan unit is detachably connected to the front of the face piece and the exhale valve is disposed on the portion of the face piece to which the fan unit is connected.

The power supply battery of the fan unit is desirably accommodated in the fan unit from the viewpoint of the convenience of the breathing apparatus. On the other hand, accommodation of the power supply battery in the fan unit results in increase of the thickness of the fan unit. Therefore, if the exhale valve is disposed on the portion of the front of the face piece to which the fan unit is connected, the fan unit excessively projects from the front of the face peace due to the increase of the thickness thereof caused by the accommodation of the power supply battery and the fact in that a space must be provided between the exhale valve and the fan unit so as to discharge the exhale air in the face piece to the environment. The excessive projection of the fan unit from the front of the face piece causes inconveniency of the breathing apparatus.

Therefore, another object of the present invention is to provide a breathing apparatus comprising a filter, a fan unit, a face piece for covering the whole face of a user, a nose cup for covering the mouth and the nose of the user, and a breath monitoring apparatus, wherein the filter is detachably connected to the fan unit, the fan unit is detachably connected to the face piece from the outside of the face piece, the nose cup is detachably connected to the face piece from the inside of the face piece, and the fan unit operates synchronously with the breath timing of the user detected by the breath monitoring apparatus, and wherein the fan unit is detachably connected to the front of the face piece, the fan unit accommodates the power supply battery, and excessive projection of the fan unit connected to the face piece from the front of the face piece is prevented.

Means for Achieving the Object

In accordance with the present invention, there is provided a breathing apparatus comprising a filter, a fan unit, a face piece for covering the whole face of a user, a nose cup for covering the mouth and the nose of the user, and a breath monitoring apparatus, wherein the filter is detachably connected to the fan unit, the fan unit is detachably connected to the face piece from the outside of the face piece, the nose cup is detachably connected to the face piece from the inside of the face piece, and the fan unit operates synchronously with the breath timing of the user detected by the breath monitoring apparatus, and wherein the breath monitoring apparatus comprises a diaphragm and a sensor for detecting movement of the diaphragm, the breath monitoring apparatus is disposed in the fan unit, an air passage and a space independent of the air passage for accommodating the diaphragm and the sensor are formed in the fan unit, a hole is formed in the face piece to communicate with the space in the fan unit when the fan unit is connected to the face piece, a hole is formed in the nose cup to communicate with the hole in the face piece when the nose cup is connected to the face piece, and the internal space of the nose cup communicates with the space in the fan unit through the hole in the nose cup and the hole in the face piece when the fan unit and the nose cup are connected to the face piece.

The breath monitoring apparatus is desirably disposed in the fan unit rather than the face piece because the face piece is detached from the fan unit and washed in water. Inhalation/exhalation-induced air pressure fluctuation appears most clearly in the internal space of the nose cup. Therefore, the diaphragm of the breath monitoring apparatus desirably receives air pressure in the internal space of the nose cup.

Location of the diaphragm and the sensor is optimized and a transmission path of inhalation/exhalation-induced air pressure fluctuation to the diaphragm is optimized by disposing the breath monitoring apparatus in the fan unit, forming the space for accommodating the diaphragm and the sensor independent of the air passage in the fan unit, forming a hole in the face piece to communicate with the space for accommodating the diaphragm and the sensor when the fan unit is connected to the face piece, forming a hole in the nose cup to communicate with the hole in the face piece when the nose cup is connected to the face piece, and communicating the internal space of the nose cup with the space for accommodating the diaphragm and the sensor formed in the fan unit through the hole in the nose cup and the hole in the face piece when the fan unit and the nose cup are connected to the face piece.

In accordance with a preferred embodiment of the present invention, the hole in the nose cup and the hole in the face piece communicate with each other when a drum formed on the nose cup to surround the hole in the nose cup resiliently fits on a drum formed on the face piece to surround the hole in the face piece.

The fan unit is usually made of hard resin material of high strength considering that high stressed portions are generated locally due to the usage of screws for fixing various components accommodated in the fan unit. Corresponding to the fan unit, the portion of the face piece connected to the fan unit is also usually made of hard resin material of high strength. On the other hand, the nose cup is made of flexible silicone resin material. Therefore, it is desirable to form a drum on the nose cup for surrounding the hole in the nose cup and a drum on the face piece for surrounding the hole in the face piece, and resiliently fit the drum of the nose cup on the drum of the face piece so as to reliably communicate the hole in the portion of the face piece made of hard material and connected to the fan unit with the hole in the nose cup made of flexible material.

In accordance with a preferred embodiment of the present invention, the breathing apparatus further comprises a pressure sensor for detecting the internal pressure of the face piece, and wherein the fan unit is provided with a light source to be activated when negative pressure is detected in the face piece, and an observation window is formed in the face piece to oppose the light source when the fan unit is connected to the face piece.

The light of the light source is directed into the face piece through the observation window because the light source activated when negative pressure is detected in the face piece is provided on the fan unit connected to the face piece and the observation window is formed in the face piece to oppose the light source provided on the fan unit. Thus, the user of the breathing apparatus can notice the lighting of the light source without fail.

In accordance with a preferred embodiment of the present invention, the light source is shut off from the environment when the fan unit is connected to the face piece.

The light source is protected from damage due to collision with foreign matter because it is shut off from the environment when the breathing apparatus is used.

In accordance with a preferred embodiment of the present invention, the light source is enclosed by opaque members except for the observation window.

The aforementioned structure increases the amount of luminous flux passing through the observation window. Thus, the user of the breathing apparatus more certainly notices the lighting of the light source.

In accordance with a preferred embodiment of the present invention, the pressure sensor for detecting the internal pressure of the face piece is the breath monitoring apparatus.

When the breath monitoring apparatus is also the sensor for detecting the internal pressure of the face piece, the number of members constituting the breathing apparatus is reduced.

In accordance with a preferred embodiment of the present invention, the fan unit is detachably connected to the front of the face piece, the fan unit accommodates a power supply battery, and the face piece is provided with an exhale valve at the side face.

When the breath monitoring apparatus is constituted of an exhale valve and a sensor for detecting movement of the exhale valve, it is reasonable to dispose the sensor on the fan unit and not on the face piece which is washed in water, and dispose the exhale valve on the portion of the face piece connected to the fan unit. However, when the breath monitoring apparatus is constituted of a diaphragm and a sensor for detecting movement of the diaphragm disposed in the fan unit, and the space for accommodating the diaphragm is communicated with the internal space of the nose cup, there is no reasonable ground to dispose the exhale valve on the portion of the face piece connected to the fan unit. Therefore, in this case, it is most reasonable to dispose the exhale valve on a portion of the face piece other than that connected to the fan unit insofar as the fan unit accommodates the power supply battery.

When the exhale valve is disposed on the side face of the face piece, the fan unit can be closely connected to the front of the face piece because no space need be provided for exhale air between the front of the face piece and the fan unit. Thus, the fan unit is prevented from projecting excessively from the front of the face piece even if the fan unit increases in thickness because it accommodates the power supply battery.

The side face of the face piece opposes the side face of the nose cup. The side face of the face piece and the side face of the nose cup are given fairly wide areas. Therefore, the side face of the face piece and the side face of the nose cup are suitable sites for installing the exhale valve and the connecting portions between the nose cup and the exhale valve.

In accordance with a preferred embodiment of the present invention, the face piece is provided with an exhale valve at either side face.

When a plurality of exhale valves are disposed on the face piece, exhale resistance decreases and the convenience of the breathing apparatus increases.

MODES FOR CARRYING OUT THE INVENTION

A breathing apparatus in accordance with a preferred embodiment of the present invention will be described.

As shown in FIGS. 1 to 7, a breathing apparatus A comprises a filter 1, a fan unit 2, a face piece 3 for covering the whole face of a user, and a nose cup 4 for covering the nose and the mouth of the user.

The filter 1 is detachably connected to the fan unit 2, the fan unit 2 is detachably connected to the face piece 3 from the outside of the face piece 3, and the nose cup 4 is detachably connected to the face piece 3 from the inside of the face piece 3.

Figure 3:
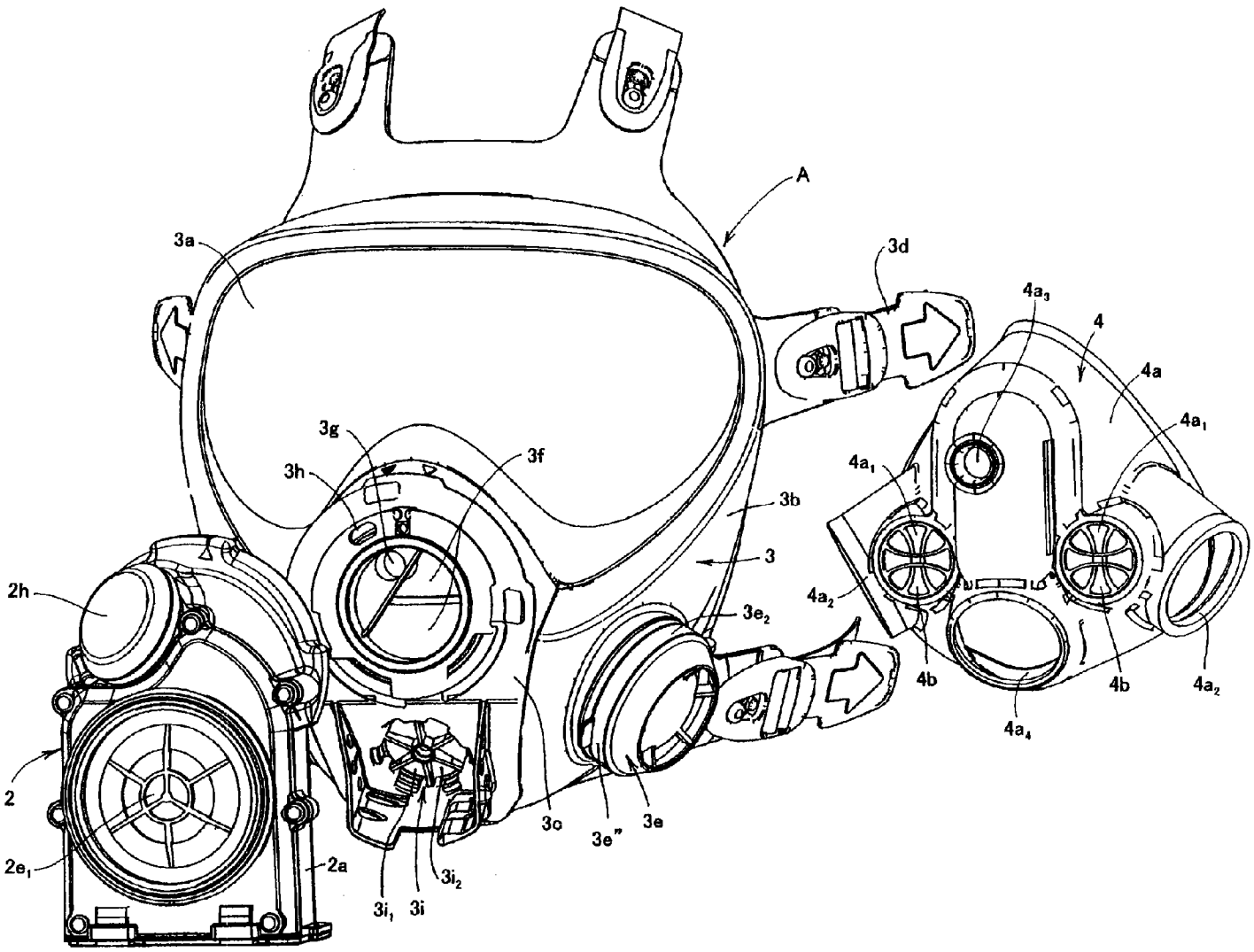
FIG. 3 is an exploded perspective view of a breathing apparatus in accordance with a preferred embodiment of the present invention as seen from the front.
Figure 4:
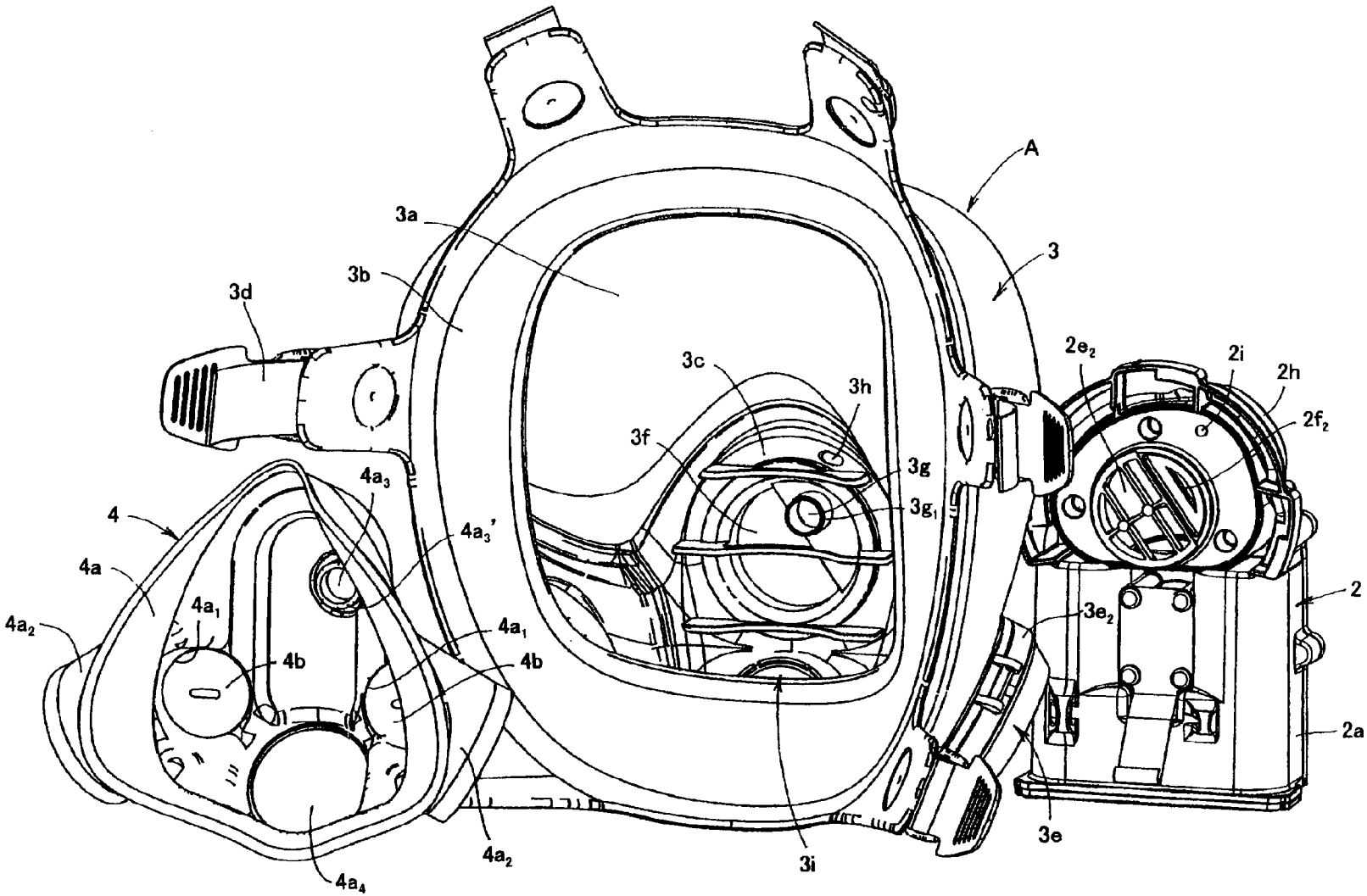
FIG. 4 is an exploded perspective view of a breathing apparatus in accordance with a preferred embodiment of the present invention as seen from the rear.
Figure 5:
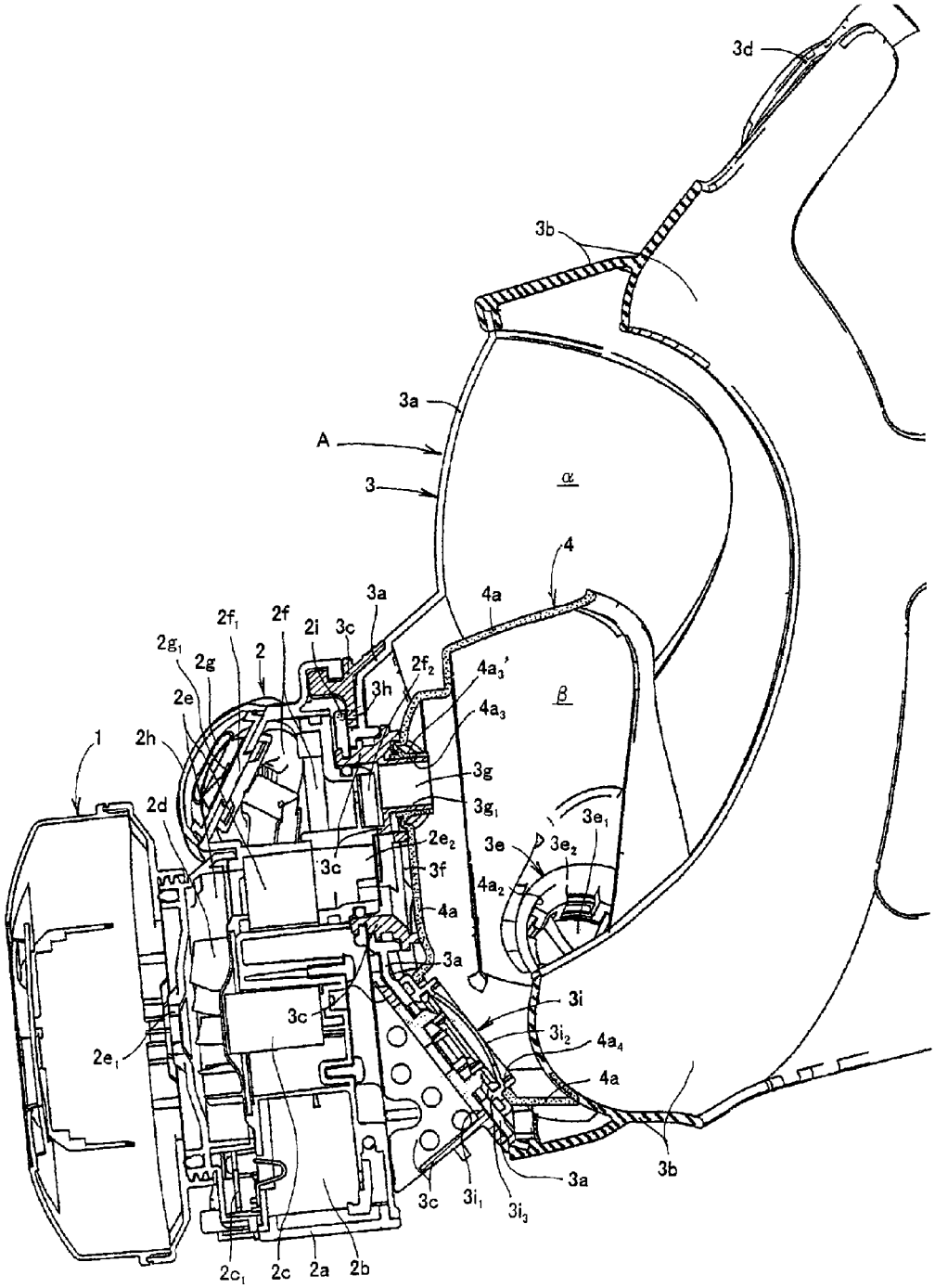
FIG. 5 is a side sectional view of a breath monitoring apparatus in accordance with a preferred embodiment of the present invention.

As shown in FIGS. 3 to 5, the fan unit 2 comprises a body 2*a*. The body 2*a* accommodates a power supply battery 2*b*, a motor 2*c* supplied with electric power from the power supply battery 2*b*, a centrifugal fan 2*d* driven by the motor 2*c*, and a controller $2c_1$ for controlling the operation of the motor 2*c*.

An air passage 2*e* penetrates the body 2*b*. The air passage 2*e* extends from an inlet $2e_1$ formed in the portion to be connected to the filter 1 through a space accommodating the fan 2*d* to an outlet $2e_2$.

A through hole 2*f* is formed in the body 2*a* independently of the air passage 2*e*. The through hole 2*f* is closed by a diaphragm 2*g* at one end $2f_1$ close to the filter 1. A sensor $2g_1$ is disposed in the through hole 2*f* so as to oppose the diaphragm 2*g* and detect the displacement of the diaphragm 2*g*. The sensor $2g_1$ is connected to the controller $2c_1$. The sensor $2g_1$ may be a magnetic sensor for detecting fluctuation of the magnetic flux density of a magnet attached to the diaphragm 2*g* or a photo sensor for shining a light beam onto the diaphragm and detecting fluctuation of the strength of the light beam reflected from the diaphragm. A cover member 2*h* provided with a small through air hole covers the diaphragm 2*g* from the outside of the body 2*a*. The other end $2f_2$ of the through hole 2*f* adjoins the outlet $2e_2$ of the air passage 2*e*. The diaphragm 2*g*, the sensor $2g_1$ and the controller $2c_1$ cooperate to form a breath monitoring apparatus for detecting breath timing of the user of the breathing apparatus.

A LED 2*i* is disposed adjacent to the other end $2f_2$ of the through hole 2*f*. The LED 2*i* is connected to the controller $2c_1$.

The body 2*a* of the fan unit 2 is made of opaque hard resin material of high strength considering that high stressed portions are generated locally due to the use of screws for fixing various components accommodated in the body 2*a*.

The face piece 3 comprises an eye piece 3*a* made of transparent resin material for covering the front portion of the face of the user, a face seal 3*b* made of silicone rubber for covering the top portion and either side portion of the face of the user, and a connecting portion 3*c* to be connected to the fan unit 2. The connecting portion 3*c* is disposed in front of the face piece 3. The eyepiece 3*a*, the face seal 3*b* and the connecting portion 3*c* are assembled as a unitary body. For good matching with the fan unit body 2*a* made of hard material, the connecting portion 3*c* is made of the same hard material as the fan unit body 2*a*.

A plurality of fastening straps 3*d* are connected to the face seal 3*b* so as to fix the face piece 3 to the head of the user.

Figure 1:
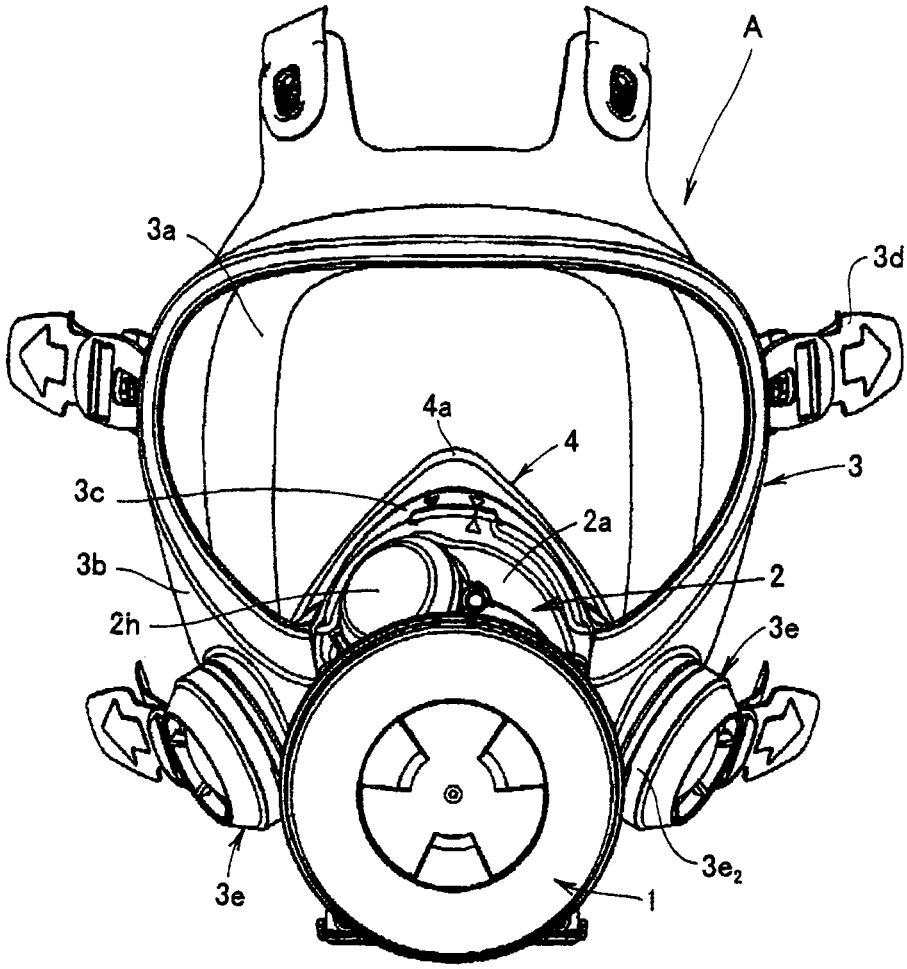
FIG. 1 is a front view of a breathing apparatus in accordance with a preferred embodiment of the present invention.
Figure 2:
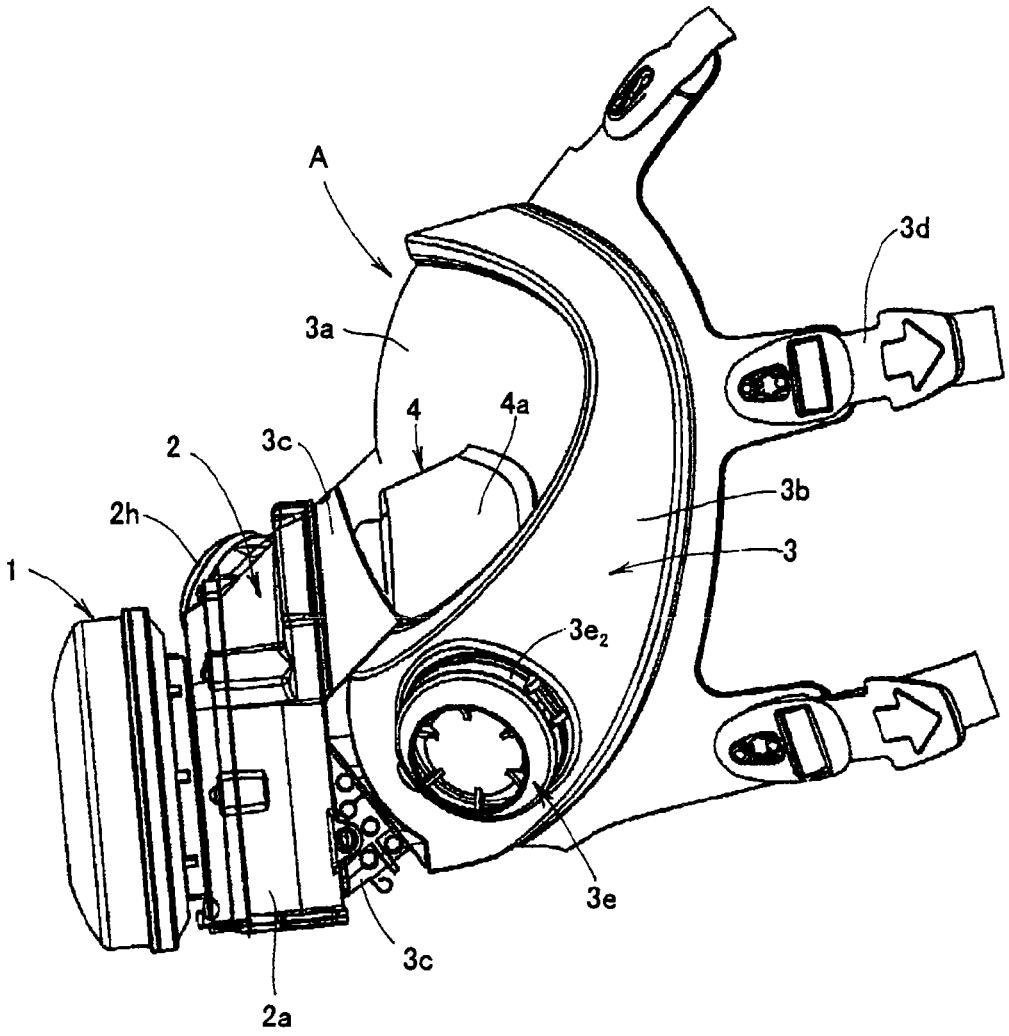
FIG. 2 is a side view of a breathing apparatus in accordance with a preferred embodiment of the present invention.
Figure 6:
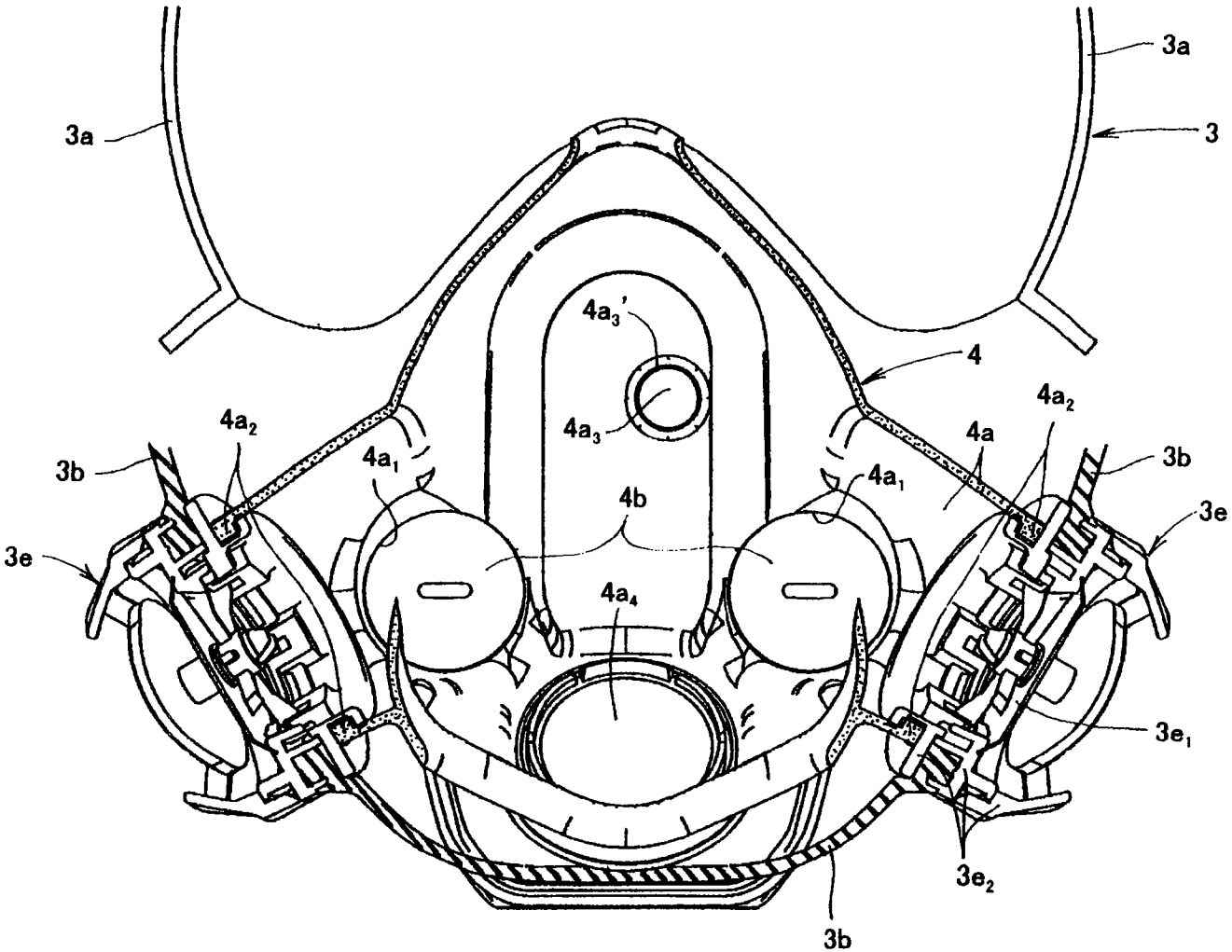
FIG. 6 is a sectional view of the face piece and the nose cup of a breathing apparatus in accordance with a preferred embodiment of the present invention as seen from the rear.
Figure 7:
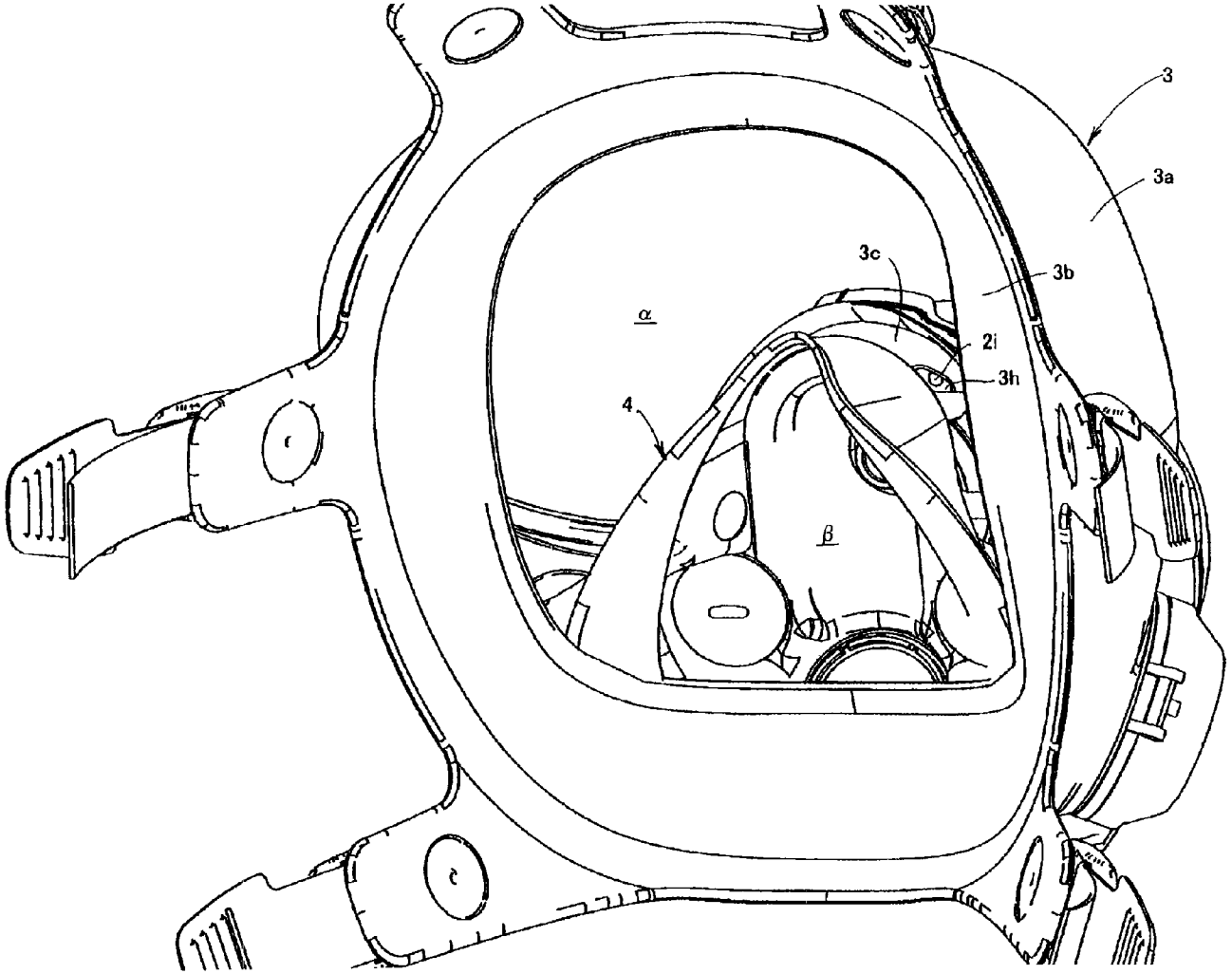
FIG. 7 is a perspective view of a breathing apparatus in accordance with a preferred embodiment of the present invention as seen from the rear.

As shown in FIGS. 1 and 6, a pair of exhale valve assemblies 3*e*, each comprising an exhale valve $3e_1$ and a drum $3e_2$ for holding the exhale valve $3e_1$, are connected to opposite side portions of the face seal 3*b* opposing the opposite side portions of the user's face.

The connecting portion 3*c* is provided with holes 3*f* and 3*g* independent of each other and adjacent to each other and a hole 3*h* close to the hole 3*g*. The hole 3*g* is surrounded by a drum $3g_1$.

The connecting portion 3*c* is provided with a speaking diaphragm 3*i* comprising a hole $3i_1$ formed in the connecting portion 3*c*, a membrane $3i_2$ for closing the hole $3i_1$ and a drum $3i_3$ for supporting the membrane $3i_2$.

The nose cup 4 comprises a body 4*a* made of silicone rubber. The body 4*a* is provided with a pair of inhale holes $4a_1$, a pair of exhale valve connecting drums $4a_2$, a hole $4a_3$ and a speaking diaphragm connecting hole $4a_4$. Each of the inhale holes $4a_1$ is provided with an inhale valve 4*b*. The hole $4a_3$ is surrounded by a drum $4a_3$'.

The filter 1 is screwed on the fan unit 2. The fan unit 2 is tightly abutted against and connected to the connecting portion 3*c* of the face piece 3 from the outside of the face piece 3 by fixing claws. The nose cup 4 is connected to the face piece 3 from the inside of the face piece 3, by resiliently fitting the exhale valve connecting drums $4a_2$ on the drums $3e_2$ of the exhale valve assemblies 3*e*, resiliently fitting the drum 4$a_3$' on the drum 3$g_1$ of the connecting portion 3*c*, and resiliently fitting the circumferential wall of the speaking diaphragm connecting hole 4$a_4$ on the drum 3$i_3$ of the speaking diaphragm 3*i*. When the nose cup 4 is connected to the face piece 3, a space is formed between them except at the portions connected to each other.

As can be seen from FIGS. 4 and 5, when the fan unit 2 and the nose cup 4 are connected to the face piece 3, the air passage outlet 2$e_2$ of the fan unit 2 communicates with the hole 3*f* of the connecting portion 3*c* of the face piece, and the hole 3*f* communicates with the internal space of the face piece 3 through the space between the nose cup 4 and the face piece 3. As a result, the air passage 2*e* of the fan unit 2 communicates with the internal space of the face piece 3.

As can be seen from FIGS. 4 and 5, when the fan unit 2 and the nose cup 4 are connected to the face piece 3, the other end 2$f_2$ of the through hole 2*f* of the fan unit 2 communicates with the hole 3*g* of the connecting portion 3*c* of the face piece 3, and the hole 3*g* communicates with the hole 4$a_3$ of the nose cup 4. As a result, the through hole 2*f* of the fan unit 2 communicates with the internal space of the nose cup 4.

As can be seen from FIGS. 3 to 5, the communicating portion between the air passage outlet 2$e_2$ and the hole 3*f*, and the communicating portion between the other end 2$f_2$ of the through hole 2*f* and the hole 3*g* are sealed off from the environment by an O-ring disposed on the fitting portion between a drum surrounding the air passage outlet 2$e_2$ and the other end 2$f_2$ of the through hole 2*f* and a drum surrounding the hole 3*f* and the hole 3*g*.

As can be seen from FIGS. 3 to 5, the communicating portion between the air passage outlet 2$e_2$ and the hole 3*f* is shut off from the communicating portion between the other end 2$f_2$ of the through hole 2*f* and the hole 3*g* because the boundary wall between the air passage outlet 2$e_2$ and the other end 2$f_2$ of the through hole 2*f* abuts the boundary wall between the hole 3*f* and the hole 3*g*. Therefore, the communicating portion between the air passage outlet 2$e_2$ and the hole 3*f* is reliably prevented from communication with the communicating portion between the other end 2$f_2$ of the through hole 2*f* and the hole 3*g*.

As can be seen from FIG. 5, when the fan unit 2 is connected to the face piece 3, the LED 2*i* opposes the hole 3*h* formed in the connecting portion 3*c* of the face piece 3, and the portion of the body 2*a* surrounding the LED 2*i* abuts the portion of the connecting portion 3*c* surrounding the hole 3*h*. As a result, the LED 2*i* is shut off from the environment. As can be seen from FIGS. 5 and 7, the user of the breathing apparatus can see the LED 2*i* from the inside of the face piece 3 through the observation window formed by the hole 3*h* and the portion of the eye piece 3*a* overlapping the connecting portion 3*c*.

Operation of the breathing apparatus A will be described.

When the user fits the breathing apparatus A on his or her face using the fastening straps 3*d*, the eye piece 3*a* of the face piece 3 covers the front portion of the face, the face seal 3*b* covers the top portion and the either side portion of the face so as to tightly abut the face, and the breathing apparatus A shuts the face of the user off from the environment. As shown in FIG. 5, the nose cup 4 covers the nose and the mouth of the user so as to abut the face of the user, thereby dividing the internal space of the face piece 3 into a first space α outside the nose cup 4 and a second space β inside the nose cup 4.

The first space α communicates with the environment through the hole 3*f*, the air passage 2*e* and the filter 1 and also with the second space β through the inhale valves 4*b*. The second space β communicates with the first space α through the inhale valves 4*b* and also with the environment through the exhale valves 3$e_1$.

When the user breathes, the internal pressure of the second space β fluctuates with the breathing, the internal pressure of the through hole 2*f* communicating with the second space β through the hole 4$a_3$ and the hole 3*g*, and the diaphragm 2*g* displaces. The displacement of the diaphragm 2*g* is detected by the sensor 2$g_1$, the detection signal is sent to the controller 2$c_1$, and the controller 2$c_1$ recognizes the fitting of the breathing apparatus A on the user. The motor 2*c* starts based on the control signal from the controller 2$c_1$, and the centrifugal fan 2*d* starts.

When the centrifugal fan 2*d* starts, environmental air passes through the filter 1 to become clean and flows into the first space α through the air passage 2*e* and the hole 3*f*, further into the second space β through the inhale valve 4*b*, and is inhaled by the user. The exhale air of the user is discharged to the environment through the exhale valve 3$e_1$.

The centrifugal fan 2 receives an operation signal from the controller 2$c_1$ to start when the sensor 2$g_1$ detects the displacement of the diaphragm 2*g* corresponding to the inhale of the user. The centrifugal fan 2 receives an operation signal from the controller 2$c_1$ to stop when the sensor 2$g_1$ detects the displacement of the diaphragm 2*g* corresponding to the exhale of the user. As a result, electric power consumption and exhale resistance become smaller than those in the case where the centrifugal fan 2*d* continuously operates.

In the breath monitoring apparatus comprising the diaphragm 2*g* and a sensor 2$g_1$ for detecting movement of the diaphragm 2*g*, no sensor need be disposed in the exhale air passage. Therefore, in the said breath monitoring apparatus, micro dust particles and water droplets dispersed in the exhale air are less likely to adhere to the sensor, the sensor is harder to be soiled, and the sensor is harder to deteriorate with age than in the conventional breath monitoring apparatus comprising an exhale valve and a sensor for detecting movement of the exhale vale.

The breath monitoring apparatus is desirably disposed in the fan unit 2 rather than the face piece 3 because the face piece 3 is detached from the fan unit 2 and washed in water. Inhalation/exhalation-induced air pressure fluctuation appears most clearly in the internal space of the nose cup 4. Therefore, the diaphragm 2*g* of the breath monitoring apparatus desirably receives air pressure in the internal space of the nose cup 4 so as to optimize the operation of the fan unit 2 synchronous to the breath timing.

Positioning of the diaphragm 2*g* and the sensor 2$g_1$ is optimized and a transmission path of inhalation/exhalation-induced air pressure fluctuation to the diaphragm 2*g* is optimized by disposing the breath monitoring apparatus in the fan unit 2, forming the fan unit 2 with the space 2*f* for accommodating the diaphragm 2*g* and the sensor 2$g_1$ independently of the air passage 2*e*, forming the face piece 3 with the hole 3*g* communicating with the space 2*f* when the fan unit 2 is connected to the face piece 3, forming the nose cup 4 with the hole 4$a_3$ communicating with the hole 3*g* of the face piece 3 when the nose cup 4 is connected to the face piece 3, and communicating the second space β, which is the internal space of the nose cup 4, to the space 2*f* of the fan unit 2 through the hole 4$a_3$ of the nose cup 4 and the hole 3*g* of the face piece 3 when the fan unit 2 and the nose cup 4 are connected to the face piece 3.

It is desirable to resiliently fit the drum 4$a_3$' formed on the nose cup 4 and surrounding the hole 4$a_3$ on the drum 3$g_1$ formed on the face piece 3 and surrounding the hole 3*g* so as to reliably communicate the hole 3*g* formed in the portion of the face piece 3 made of hard material with the hole $4a_3$ formed in the nose cup 4 made of flexible material.

When the internal pressure of the second space β becomes negative for a predetermined time duration, the controller $2c_1$ recognizes said fact based on the detection of the displacement of the diaphragm 2*g* so as to light the LED 2*i*. As can be seen from FIG. 7, the user can see the lighting of the LED 2*i* from the inside of the face piece 3 through the observation window formed by the hole 3*h* disposed in the connecting portion 3*c* made of opaque resin material and the portion of the eye piece 3*a* made of transparent resin material abutting the connecting portion 3*c*.

The light of the LED 2*i* is directed into the face piece 3 through the observation window 3*h* as the LED 2*i* to be lightened when negative pressure is detected in the face piece is provided on the fan unit 2 connected to the face piece 3 and the observation window 3*h* is formed in the face piece 3 so as to oppose the LED 2*i*. Thus, the user of the breathing apparatus unfailingly notices the lighting of the LED 2*i* so as to perceive that the time has come to replace the filter 1 or the time has come to charge the power supply battery 2*b*.

The LED 2*i* is protected from damage due to collision with foreign matters as the LED 2*i* is shut off from the environment when the breathing apparatus A is used.

The LED 2*i* is enclosed by opaque resin material. The light of the LED 2*i* is directed into the face piece 3 through the observation window formed by the hole 3*h* provided in the connecting portion 3*c* made of opaque resin material. The aforementioned structure increases the amount of luminous flux passing through the hole 3*h*. Thus, the user of the breathing apparatus more certainly notices the lighting of the LED 2*i*.

The breath monitoring apparatus comprising the diaphragm 2*g* and the sensor $2g_1$ is also the sensor for detecting negative pressure in the face piece 3. Thus, the number of members constituting the breathing apparatus becomes less than that in the case where the breath monitoring apparatus and the sensor for detecting the negative pressure are disposed independently of each other.

The breathing apparatus A becomes more convenient in the case where the power supply battery is accommodated in the body 2*a* of the fan unit 2 than in the case where the power supply battery is disposed independently of the fan unit.

When the breath monitoring apparatus is constituted of an exhale valve and a sensor for detecting movement of the exhale valve, it is reasonable to dispose the sensor on the fan unit and not on the face piece which is washed in water, and dispose the exhale valve on the portion of the face piece connected to the fan unit. However, when the breath monitoring apparatus is constituted of the diaphragm 2*g* disposed in the fan unit 2 and the sensor $2g_1$ for detecting movement of the diaphragm 2*g*, and the space 2*f* for accommodating the diaphragm is communicated with the internal space β of the nose cup 4, there is no reasonable ground for disposing the exhale valve $3e_1$ on the portion 3*c* of the face piece 3 connected to the fan unit 2. Therefore, in this case, it is most reasonable to dispose the exhale valve $3e_1$ on a portion of the face piece 3 other than that connected to the fan unit 2 insofar as the fan unit 2 accommodates the power supply battery 2*b*.

When the exhale valves $3e_1$ are disposed on the either side face of the face piece 3, the fan unit 2 can be located close to the connecting portion 3*c* in front of the face piece 3 and connected to the face piece 3 as no space need be provided between the connecting portion 3*c* in front of the face piece 3 and the fan unit 2 for easy flow of the exhale air. Thus, the fan unit 2 is prevented from projecting excessively from the front of the face piece 3 due to the fact that the fan unit 2 is increased in thickness by accommodation of the power supply battery 2*b*, and the breathing apparatus A is prevented from loss of convenience.

The side faces of the face piece 3 oppose the side faces of the nose cup 4. The side faces of the face piece 3 and the side faces of the nose cup 4 are given with fairly wide areas. Therefore, the side faces of the face piece 3 and the side faces of the nose cup 4 are suitable for installation of the exhale valve assemblies 3*e* and the exhale valve connecting drums $4a_2$.

When the exhale valves $3e_1$ are disposed on the either side of the face piece 3, exhale resistance decreases and the convenience of the breathing apparatus A increases.

INDUSTRIAL APPLICABILITY

The present invention can be widely applied to breathing apparatuses.

BRIEF DESCRIPTION OF THE REFERENCE NUMERALS

A Breathing Apparatus
1 Filter
2 Fan unit
2*d* Centrifugal fan
2*e* Air passage
2*f* Through hole
2*g* Diaphragm
2*i* LED
3 Face piece
3*a* Eye piece
$3e_1$ Exhale valve
3*g* Hole
3*h* Hole
4 Nose cup
$4a_3$ Hole
4*b* Inhale valve

The invention claimed is:

1. A breathing apparatus comprising:

(a) a filter;

(b) a fan unit;

(c) a face piece for covering the whole face of a user;

(d) a nose cup for covering the mouth and the nose of the user; and (e) a breath monitoring apparatus, wherein the filter is detachably connected to the fan unit, the fan unit is detachably connected to the face piece from an outside of the face piece, the nose cup is detachably connected to the face piece from an inside of the face piece, and the fan unit operates synchronously with a breath timing of a user that is detected by the breath monitoring apparatus, wherein the breath monitoring apparatus comprises a diaphragm and a sensor for detecting movement of the diaphragm, wherein the breath monitoring apparatus is disposed in the fan unit, wherein an air passage and a space independent of the air passage arranged to accommodate the diaphragm and the sensor are formed in the fan unit, wherein a hole is formed in the face piece so that, when the fan unit is attached to the face piece, the hole and the space communicate, wherein a hole is formed in the nose cup, so that, when the nose cup is attached to the face piece, the hole in the nose cup and the hole in the face piece communicate, and wherein an internal space of the nose cup communicates with the space in the fan unit through the hole in the nose cup and the hole in the face piece when the fan unit and the nose cup are connected to the face piece.

2. A breathing apparatus of claim 1, further comprising a drum formed on the nose cup surrounding the hole in the nose cup, and a drum formed on the face piece surrounding the hole in the face piece, wherein the hole in the nose cup and the hole in the face piece communicate with each other when the drum formed on the nose cup resiliently fits on the drum formed on the face piece.

3. A breathing apparatus of claim 1, further comprising a pressure sensor operably connected to detect the internal pressure of the face piece, wherein the fan unit is provided with a light source that is activated when negative pressure is detected in the face piece, and wherein an observation window is formed in the face piece so that the observation window opposes the light source when the fan unit is connected to the face piece.

4. A breathing apparatus of claim 3, wherein the light source is isolated from an environment surrounding the breathing apparatus when the fan unit is connected to the face piece.

5. A breathing apparatus of claim 4, wherein the light source is enclosed by at least one opaque member, and wherein the observation window is not covered.

6. A breathing apparatus of claim 3, wherein the pressure sensor for detecting the internal pressure of the face piece is the breath monitoring apparatus.

7. A breathing apparatus of claim 1, wherein the fan unit is detachably connected to a front of the face piece, wherein the fan unit accommodates a power supply battery, and wherein the face piece is provided with an exhale valve disposed on at least one of at a first side surface or a second side surface.

8. A breathing apparatus of claim 7, wherein the face piece is provided with exhale valves at the first side surface and the second side surface.

* * * * *